United States Patent [19]

McFarland

[11] Patent Number: 4,627,326

[45] Date of Patent: Dec. 9, 1986

[54] MUSICAL FAUCET

[76] Inventor: John McFarland, Box 478, Victor, Mont. 59875

[21] Appl. No.: 753,885

[22] Filed: Jul. 11, 1985

[51] Int. Cl.[4] ..... G10F 1/06

[52] U.S. Cl. ..... 84/94 C; D17/24

[58] Field of Search ..... 84/94 R, 94 C, 95 R, 84/95 C, 96, 101; D17/24; 446/176, 180, 201, 217, 218; 290/43, 54

[56] References Cited

U.S. PATENT DOCUMENTS

| | | | |
|---|---|---|---|
| 2,252,289 | 8/1941 | Kind et al. | 84/95 C |
| 2,504,632 | 4/1950 | Blair | 84/101 |
| 2,908,997 | 10/1959 | Handler | 84/94 R |
| 2,955,502 | 10/1960 | Ventura | 84/94 R |
| 4,252,273 | 2/1981 | Karterman | 446/201 X |
| 4,466,327 | 8/1984 | Hinton | 84/95 R |

*Primary Examiner*—L. T. Hix
*Assistant Examiner*—Brian W. Brown
*Attorney, Agent, or Firm*—Paul F. Horton

[57] ABSTRACT

A musical faucet for producing a musical tune upon the opening of a water tap including a waterpower take-off in the form of a water wheel located within a water conduit; a musical comb with tuned tines; and a rotatable striker member, preferably in the form of a cylinder or endless belt, having a multiplicity of striker pins for impacting the tines of the comb to produce music. The striker member is powered by the water wheel and may be integral therewith. The comb and striker member may be connected externally to the water conduit or may be within the conduit. A sealed housing or a cavitation baffle may be used when the comb and striker member are located within the water conduit.

12 Claims, 5 Drawing Figures

MUSICAL FAUCET

BACKGROUND OF THE INVENTION

1. Field of the Invention

This invention relates, in general to musical devices and in particular to mechanical musical devices which are activated and powered by the flow of water from a faucet.

2. Description of the Prior Art

The desireability of having music played while performing daily tasks has long been recognized. Music boxes, which play music while one grooms oneself, having long been and still are a popular form of music—playing well known favorite tunes in a simple yet charming manner. Such boxes are generally powered by a self contained coil spring and activated by an opening of the box. Also, musical toys, such as those typified by U.S. Pat. Nos. 2,908,997 and 2,955,502, deriving their power from manually activated cranks or wheels, have long given musical pleasure to their operators. Music has long been associated with running water—as experienced by those who sing in the rain or while taking a shower. Music also frequently accompanies "dancing waters" or fountain displays. Unknown to the inventor, however, is a musical device which is activated and powered by water flowing through a conduit; the flow of the water and therefore the music being controlled by a water tap.

SUMMARY OF THE INVENTION

The present invention comprises, generally, a musical faucet including a water conduit, a waterpower take-off means within the conduit, and music production means driven by and activated by said waterpower take-off means. The music production means is preferably a musical comb provided with a plurality of tuned tines and a rotatable striker member. A more complete and accurate discription of the invention may be found in the appended claims.

It is therefore a primary object of the present invention to provide music production means which is activated and driven by a water wheel contained within a water conduit.

More specifically, it is an object of the present invention to provide music production means which includes a musical comb with tuned tines and a rotatable striker provided with a multiplicity of pins set in a preselected pattern and operable to strike the tines for the production of music; said striker being driven by a waterwheel contained within a water conduit.

Additional objects and advantages will become apparent and a more thorough and comprehensive understanding may be had from the following description taken in conjunction with the accompanying drawings forming a part of this specification.

DETAILED DESCRPTION OF THE INVENTION

Figure 1:
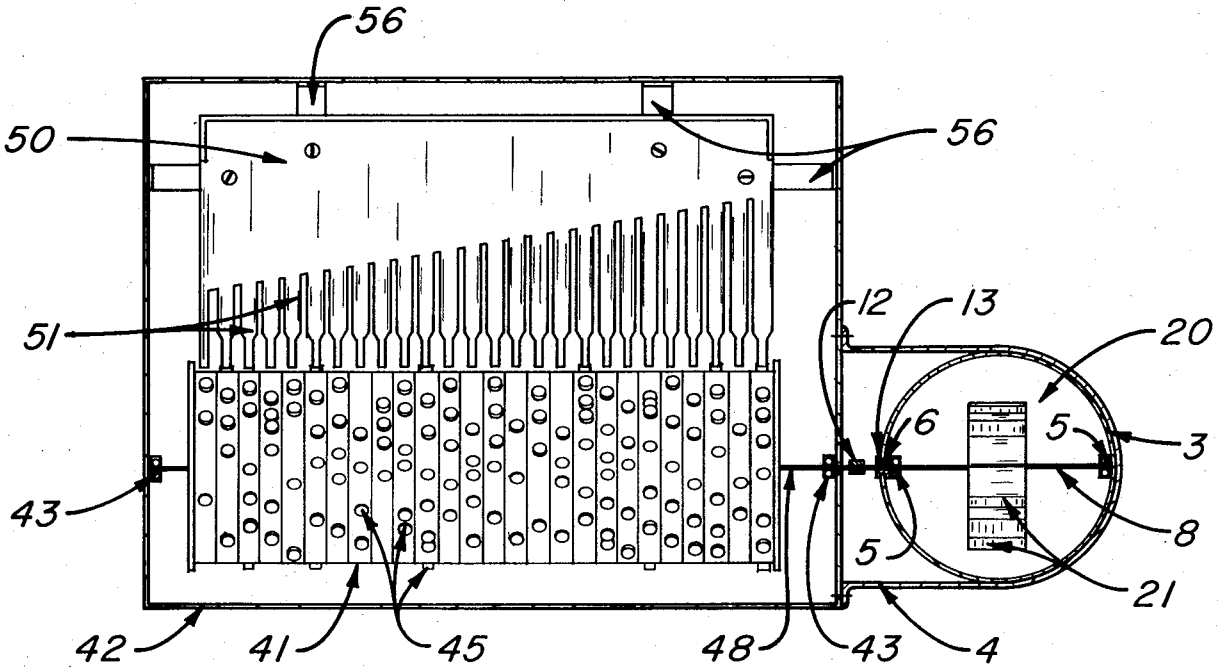
FIG. 1 is a frontal view in partial section of one embodiment of the present invention.

Referring now to the drawings, embodiments to be preferred of a musical water faucet 10, made according to the present invention is disclosed. Faucet 10 includes a water conduit 3; waterpower take-off means designated generally by the numeral 20; and music production means designated generally by the numeral 40.

Water conduit 3 is a standard pipe, preferably constructed of galvanized iron, as is conventional for domestic water purposes. Conduit 3 includes an inlet port 2 and an outlet port 4 and may be used for drawing water for sinks, bathtubs, showers and the like. The inlet port is connected to a water source and the outlet port may be connected to a conventional water tap 7 for turning on the water, turning off the water, or for controlling water flow.

Referring now to FIG. 1, in particular, a first preferred embodiment of musical faucet 10 is shown. Contained within conduit 3 and rotatably mounted by shaft 8 on support bearings 5 is waterpower take-off means 20 in the form of a waterwheel having a plurality of water vanes 21. Vanes 21 may be all sloped at a particular angle relative to the axis of the wheel so as to provide greater resistance on one part of the wheel than another to flow of water for turning the wheel, or may be provided with hinges so that the vanes collapse in one direction only, providing the same function. Shaft 8 extends through an opening 6 in the wall of the conduit and is connected to shaft 48 of cylinder 41 of music production means 40 by an appropriate coupler 12. O-rings 13, or other suitable seals, prevent leakage of water about the shaft. While waterwheel 20 is shown within a conventional conduit which may have an inside diameter of three-quarters of an inch or one inch, it is obvious that a larger conduit can be used if desired, by a simple coupling to the existing water line.

Music production means 40, in the first embodiment, includes a housing 42 having a comb 50 and a rotatably mounted striker member in the form of a drum or cylinder 41. Comb 50 is affixed to the housing in a stationary position, as by brackets 56 and cylinder 41 is rotatably supported by bearings 43. Comb 50 is provided with a selected number of tuned tines 51 which are impacted by projections or pins 45 outwardly and preferably radially extending from cylinder 41. Pins 45 are each set at preselected positions about the surface of the cylinder to strike tines 51 at a predetermined interval relative to other pins, to produce a musical tune. It is obvious that the faster the rotation of the cylinder, the faster the tune is played. An opening, not shown, in housing 42 permits exchange or substitution of cylinders 41 for the playing of a different selection of tunes. The housing may be secured to water conduit 3 as by clamp 4.

Figure 2:
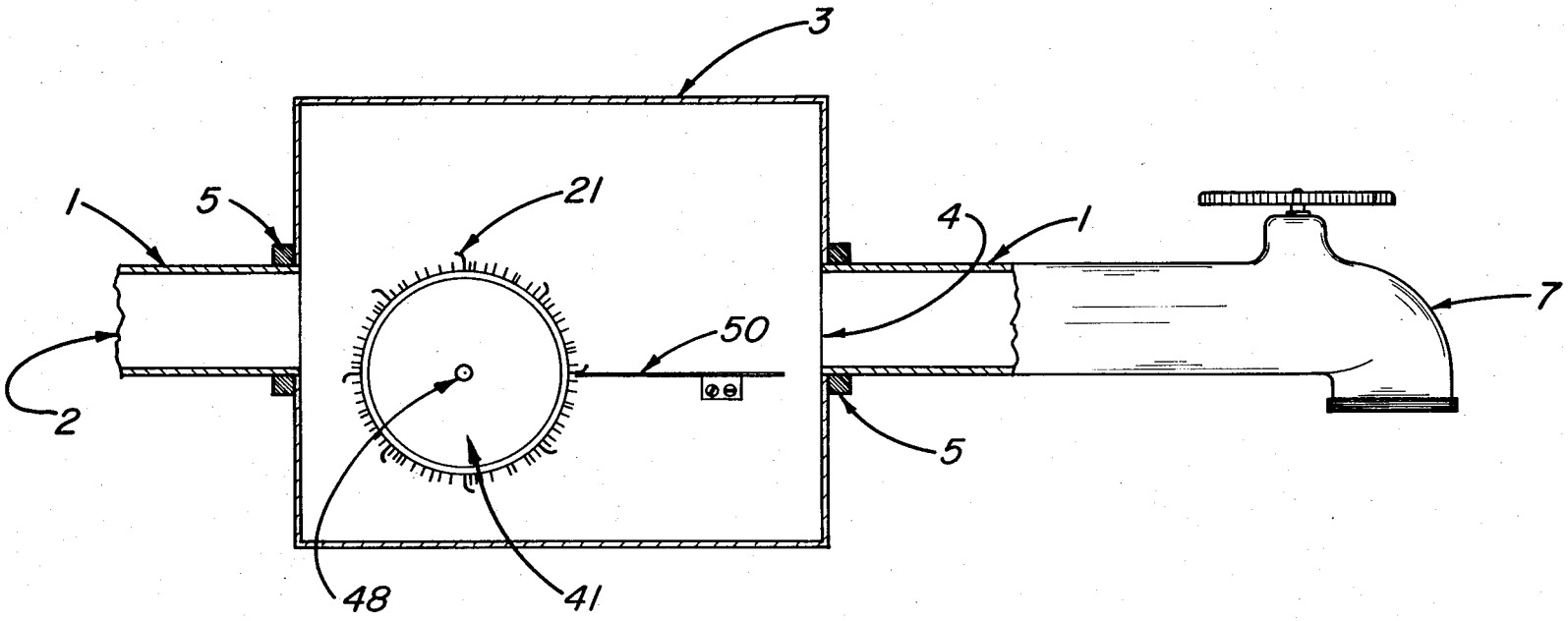
FIG. 2 is a side view in partial section of a second embodiment of the present invention.
Figure 3:
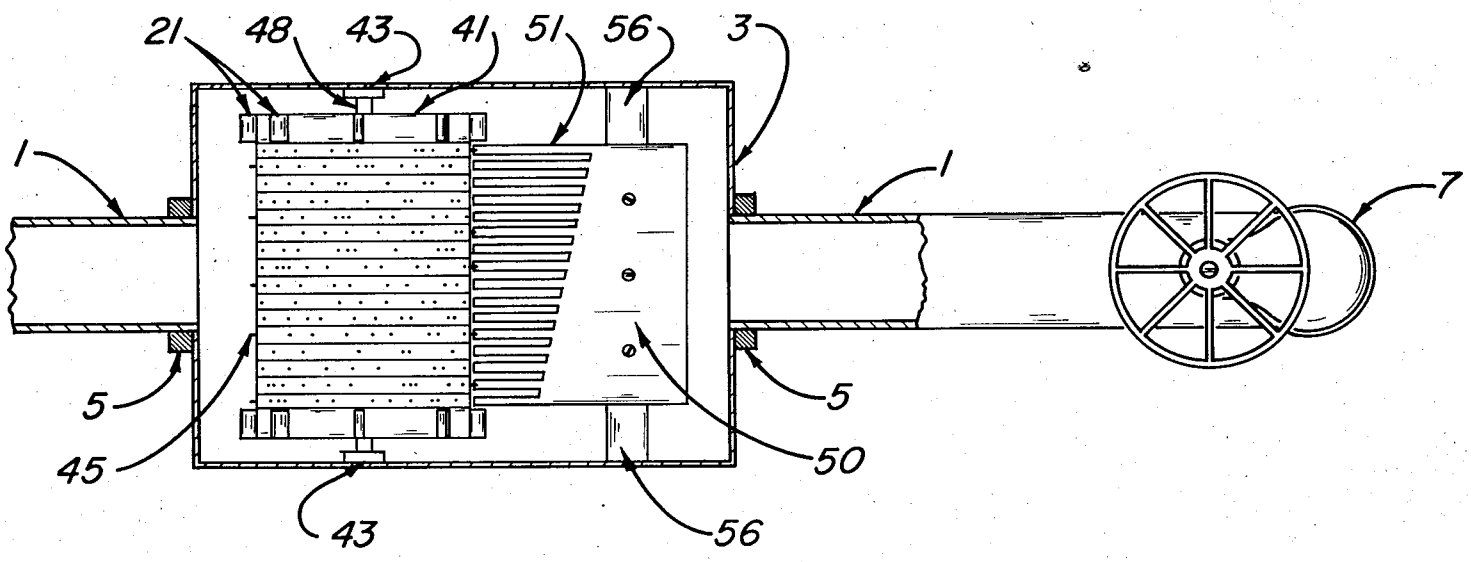
FIG. 3 is a plan view in partial section of the embodiment shown in FIG. 2.

Referring now to FIGS. 2 and 3, a second embodiment of the musical faucet 10, is hown. In this embodiment a watertight tubular conduit 3 of substantially greater diameter than existing waterline 1 is installed by standard pipe fittings 5. Contained within conduit 3 is a rotatable cylinder 41, provided with a shaft 48 mounted upon support bearings 43 and a musical comb 50 affixed to the walls of the conduit by means of support brackets 56. As in the first embodiment, tuned tines 51 of comb 50 are impacted by pins 45 of cylinder 41 to play a tune. Tuning of the tines is dependent upon the damping effect of the water.

Mounted upon cylinder 41 are water vanes 21 which, like the vanes of the first embodiment, are engaged by the flow of water to rotate the cylinder. The waterpower take-off means is therefore integral with the striker means, cylinder 41. Water flow is controlled by tap 7.

Figure 4:
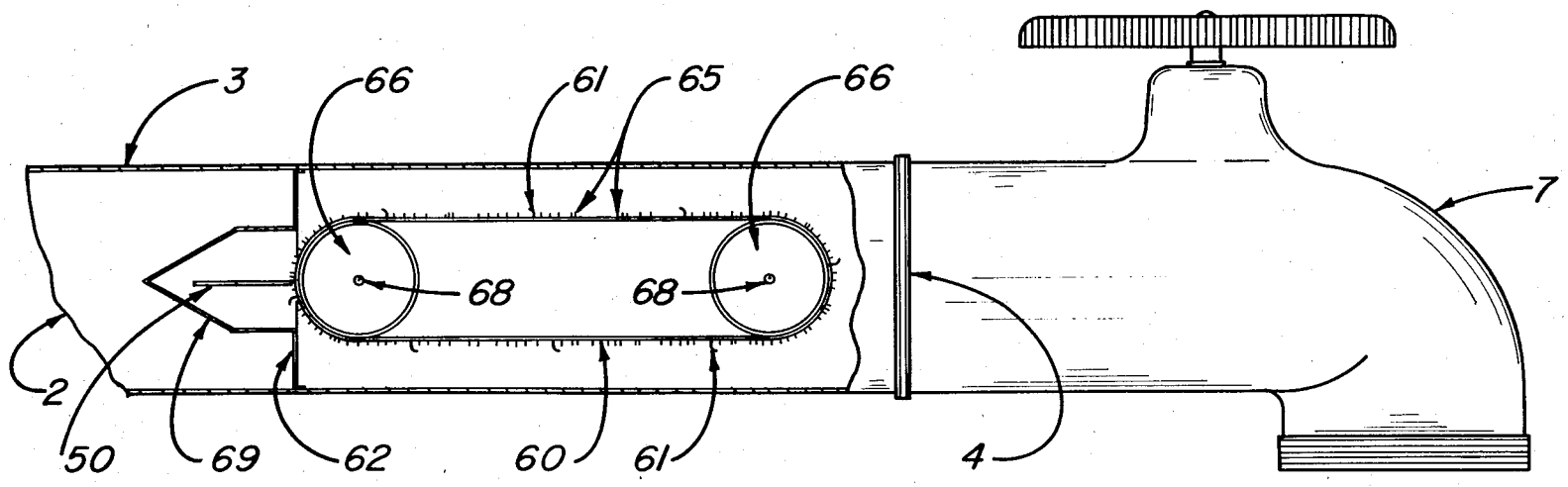
FIG. 4 is a side view in partial section of a third embodiment of the present invention.
Figure 5:
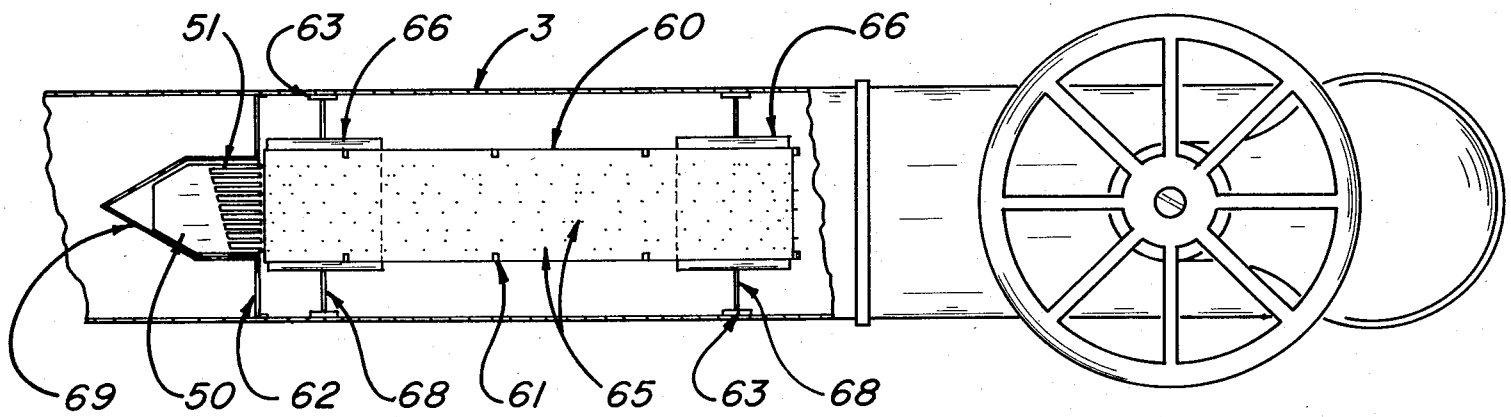
FIG. 5 is a plan view in partial section of the embodiment shown in FIG. 4.

Referring now to FIGS. 4 and 5, a third embodiment of the present invention is shown to advantage. In this embodiment the water take-off means is also integral with the striker means, being in the form of an endless belt 60 rotatably supported by drums 66 having shafts 68 supported by bearings 63. Belt 60 is provided with a plurality of vanes 61 which may be of similar design to the vanes of other embodiments of the invention, for providing for rotation of the belt by their engagement with the flow of water. Belt 60, including both the power take-off means and the striker means, also includes a multiplicity of pins 65 upwardly projecting from the exterior surface of the belt, operable to engage tines 51 of comb 50, which is securely mounted to the sidewalls of the conduit, for the production of music. A baffle 69, preferably hollow and cone-shaped in configuration may be mounted to the side wall of conduit 3 by mounting brackets 62, to form a cavitation chamber surrounding comb 50 with its tines 51 and their engagement with pins 65 of belt 60. The cavitation chamber provides a more stable environment for sound production than does the area of water flow.

For operation, tap 7, which may be a shower tap, sink tap, or any other tap, is opened to provide a flow of water. As water flows through conduit 3 and out tap 7, water take-off means 20, in the form of a waterwheel as shown in FIG. 1 or as a combination cylinder as shown in FIGS. 2 and 3 or as a water belt as shown in FIGS. 4 and 5, is activated causing rotation of the striker means, shown as a cylinder 41 in FIGS. 1,2, and 3 or as a belt 60 in FIGS. 4 and 5, causing impact between the pins and the tuned tines of comb 50 for the production of music, either externally of the water conduit as shown in the first embodiment or internally within the conduit as shown in the second and third embodiments. The speed with which the tune is played may be controlled by turning the tap handle to regulate the flow of water.

Having thus described in detail a preferred selection of embodiments of the present invention, it is to be appreciated and will be apparent to those skilled in the art that may physical changes could be make in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A musical water faucet apparatus:

a water conduit;

water take-off means located within said conduit;

a water tap for controlling the flow of water within said conduit; and music production means connected to and driven by said waterpower take-off means.

2. The apparatus as described in claim 1 wherein said waterpower take-off means comprises a water wheel.

3. The apparatus as described in claim 1 wherein said music production means includes a comb having a multiplicity of tuned tines and striker means rotatably driven by said waterpower take-off means, said striker means provided with a multiplicity of striker pins, each of which are operable to engage preselected tines for the production of musical sounds.

4. The apparatus as described in claim 3 wherein said striker means includes a cylinder provided with a multiplicity of pins spacially arranged in a predetermined pattern.

5. The apparatus as described in claim 3 wherein said striker means includes a belt mounted on two or more rotatable drums, said belt provided with a multiplicity of pins spacially arranged in a predetermined pattern.

6. The apparatus as described in claim 1 wherein said music production means is located externally to said conduit.

7. The apparatus as described in claim 1 wherein said music production means is located within said conduit.

8. A musical water faucet apparatus comprising:

a water conduit;

water power take-off means located within said conduit;

a tap for controlling the flow of water within said conduit;

a comb provided with a plurality of tuned tines, said comb mounted within said conduit; and tine striker means rotatably mounted within said conduit, said striker means driven by said waterpower take-off means and said striker means provided with a multiplicity of stiker pins operable to engage selected tines of said comb in a predetermined order to the production of music.

9. The apparatus as described in claim 8 wherein said water take-off means is integral with said striker means.

10. The apparatus as described in claim 8 wherein said striker means includes a cylinder provided with striker pins outwardly projecting from the exterior surface of said cylinder.

11. The apparatus as described in claim 8 wherein said striker means includes at least two rotatable drums and an endless belt mounted on said drums, said belt provided with striker pins outwardly projecting from the external surface thereof.

12. The apparatus as described in claim 8 further comprising a cavitation baffle located immediately upstream and adjacent said comb to divert water around the tines of said comb at their area of impact with said striker means.

* * * * *